United States Patent [19]

Wachi et al.

[11] 4,246,823

[45] Jan. 27, 1981

[54] WAVESHAPE GENERATOR FOR ELECTRONIC MUSICAL INSTRUMENTS

[75] Inventors: Masatada Wachi; Mitsumi Katoh; Koji Niimi, all of Hamamatsu, Japan

[73] Assignee: Nippon Gakki Seizo Kabushiki Kaisha, Japan

[21] Appl. No.: 955,523

[22] Filed: Oct. 30, 1978

[30] Foreign Application Priority Data

Nov. 1, 1977 [JP] Japan ..... 52/130283

[51] Int. Cl.[3] ..... G10H 1/08; G10H 7/00

[52] U.S. Cl. ..... 84/1.22; 84/1.01; 84/1.19

[58] Field of Search ..... 84/1.01, 1.03, 1.11, 84/1.19, 1.22

[56] References Cited

U.S. PATENT DOCUMENTS

| | | | |
|---|---|---|---|
| 3,809,789 | 5/1974 | Deutsch | 84/1.01 |
| 3,888,153 | 6/1975 | Deutsch | 84/1.01 |
| 3,982,460 | 9/1976 | Obayashi et al. | 84/1.01 X |
| 3,982,461 | 9/1976 | Kugisawa | 84/1.03 |
| 4,127,047 | 11/1978 | Tomisawa | 84/1.01 |
| 4,133,241 | 1/1979 | Niimi et al. | 84/1.01 |

*Primary Examiner*—Stanley J. Witkowski

*Attorney, Agent, or Firm*—Ostrolenk, Faber, Gerb & Soffen

[57] ABSTRACT

In a wave shape generator of the memory reading type, a waveshape memory stores sample values of a wave each value being represented by an integral address. A coefficient memory stores coefficients for nth order interpolation. Unknown intermediate sample values not stored in the wave shape memory represented by non-integral addresses and are approximated by multiplication of stored sample values of the waveshape and corresponding coefficient values on the basis of nth order interpolation. Use of the interpolation method assures smoothness of the wave shape with respect to time and thereby minimizes quantization noise while permitting use of relatively small memories.

16 Claims, 6 Drawing Figures

WAVESHAPE GENERATOR FOR ELECTRONIC MUSICAL INSTRUMENTS

BACKGROUND OF THE INVENTION

The present invention relates to a wave shape generator for electronic musical instruments, and more particularly relates to improvement in a wave shape memory in which a certain wave shape stored in a wave shape memory is read out by periodical address signals in order to produce a wave shape signal to be used for generation of a corresponding musical tone.

In an electronic musical instrument, a wave shape generator having one or more wave shape memories is used for generation of musical tone wave shapes and envelope wave shapes. The wave shape generator outputs musical tone wave shapes upon receipt of frequency information from the associated frequency information memory.

In the case of the conventional wave shape generator of the above-described type, only the integer part of the accumulated value of the frequency information is utilized as the read-out address signal for the wave shape memory. This partial utilization of the given information naturally leads to low accuracy of read-out address signals with respect to the time axis and a large amount of quantization noise in the obtained musical tone wave.

In order to avoid the above-described disadvantages, it is necessary to increase the address shifting speed and to enlarge the data storing capacity of the memories.

SUMMARY OF THE INVENTION

It is one object of the present invention to provide a wave shape generator having a compact memory yet assuring high accuracy of read-out wave shape with respect to the time axis.

It is the other object of the present invention to provide a wave shape generator of a compact size yet able to produce musical tone wave shapes with minimum quantization noise.

In accordance with the present invention, both the integer part and the fractional part are used as read-out address signals, the former being for wave shape memory addressing and the latter being for the coefficient memory. Sample values from the wave shape memory are multiplied by corresponding coefficient values from the coefficient memory for production of unknown intermediate sample values on the basis of an interpolation method.

DESCRIPTION OF THE PREFERRED EMBODIMENT

Figure 1:
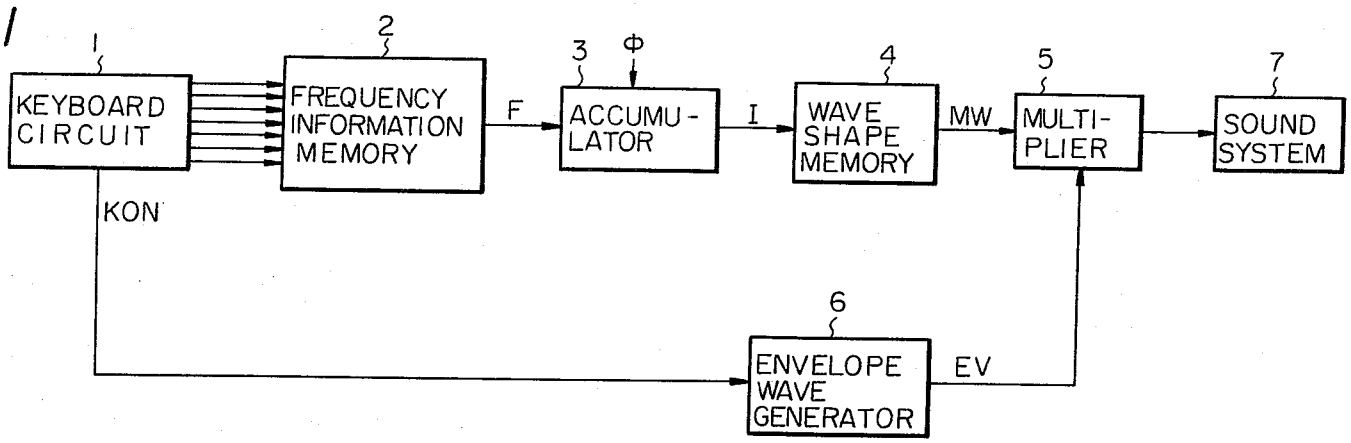
Fig. 1 PRIOR ART
FIG. 1 is a block diagram showing the construction of a conventional wave shape generator for electronic musical instruments.

One typical example of the conventional electronic musical instructment of a wave memory reading type is shown in FIG. 1, in which a keyboard circuit 1 outputs a logic value "1" to one of its output lines when a corresponding key is operated on the associated keyboard. For the sake of simplicity of explanation, a monophonic instrument is herein disclosed. The keyboard circuit 1 is provided with a single tone selecting circuit (not shown) which has the function of singling out one tone when two or more keys are operated simultaneously on the keyboard. One typical example of such a single tone selecting circuit is disclosed in the U.S. Pat. No. 3,981,217 to Oya issued on Sep. 21, 1976. The keyboard circuit 1 is generative of a key-on signal which designates key operation on one of the keys in the keyboard.

The output lines of the keyboard circuit 1 are coupled to corresponding input terminals of a frequency information memory 2 which stores frequency information F, each of which corresponds to the tonal pitch of a corresponding key. Consequently, when a key is operated, frequency datum F corresponding to the tonal pitch of that key is read out from the frequency information memory 2. The output terminal of the frequency information memory 2 is coupled to an input terminal of an accumulator 3.

Upon receipt of a series of clock pulse signals $\phi$, the accumulator 3 accumulates frequency data F sequentially outputted from the frequency information memory 2 and outputs sequentially the integer part I of the accumulated values qF (q=1, 2, 3,---) as read-out address signals. The output terminal of the accumulator 3 is coupled to the input side of a musical tone wave shape generator including a wave shape memory 4.

Figure 2:
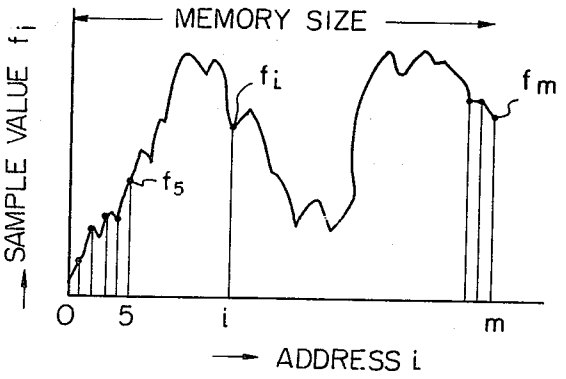
FIG. 2 is a graph for showing an example of a musical tone wave shape to be stored in the wave shape memory.

The wave shape memory 4 is provided with a number of addresses each of which stores a sample value fi(i=0, 1, 2, 3,---) of a desired musical tone wave shape such as the one shown in FIG. 2. Consequently, upon receipt of address signals I from the accumulator 3, the wave shape memory 4 reads out sample values fi stored in addresses corresponding to the given address signals I in order to output a musical tone wave shape MV constructed by the read-out sample values fi. This musical tone wave shape MV is passed to a multiplier 5.

Concurrently with the above-described process, an envelope wave shape generator 6 outputs to multiplier 5 an envelope wave shape signal EV upon receipt of a key-on signal KON from the keyboard circuit 1.

Thus the musical tone wave shape MV from the wave shape memory 4 and the envelope wave shape EV from the generator 6 are multiplied to each other by the multiplier 5, whereby a proper tone volume envelope is given to the musical tone wave. After this multiplication, the resultant complete wave is passed to a sound system 7 for generation of a desired musical tone. The sound system 7 comprises a tone volume controller, amplifiers and loud speakers.

Figure 3:
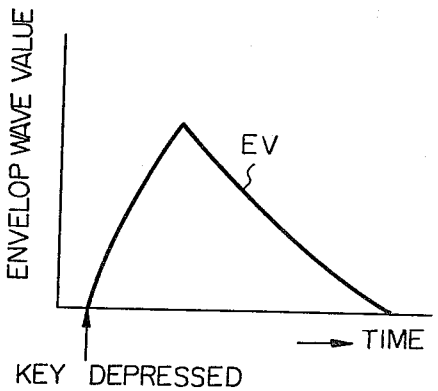
FIG. 3 is a graph for showing an example of an envelope wave shape to be outputted from an envelope wave shape generator.

One example of an envelope wave shape that might be outputted by the envelope wave shape generator 6 is shown in FIG. 3. Selection of the envelope wave shape to be multiplied to the musical tone wave shape is carried out by player's operation of tone color selection switches provided on the operation panel of the musical instrument.

As is clear from the foregoing description, the readout address signal to be outputted from the accumulator 3 is representative only of the integer part I of the corresponding accumulated value qF, while disregarding the fractional part of the same at all. In other words, the musical tone wave shapes MW outputted from the wave shape memory 4 are more or less quantized with respect to time, and such quantization seriously degrades the smoothness of the musical tone wave shapes with respect to the time axis.

In addition, the sample values fi stored in the addresses of the wave shape memory 4 are not continuous with each other but discontinuous from each other as shown in FIG. 2. Therefore, the musical tone wave shapes MW to be read out from the wave shape memory 4 by the corresponding address signals I in general include a large amount of quantization noise.

In order to avoid the above-described disadvantages, it is required to increase the address shifting speed of the wave shape memory 4 and to increase the number of addresses in the wave shape memory 4. In this way, the musical tone wave shapes can be divided very finely and the large number of sample values so obtained can be distributed into the increased number of addresses in the wave shape memory 4. However, this solution inevitably requires enlarging the wave shape memory.

As described already, the present invention contemplates the provision of a wave shape generator with a very compact wave shape memory yet assuring good smoothness in the generated musical tone wave shape and minimizing the quantization noises.

The present invention is based on a principle in which an unknown sample value between two neighboring given sample values is estimated (calculated) and thus generated via the interpolation method on the basis of the sequential sample values actually stored in the addresses (0, 1, 2, ---, I, ---, m) of the wave shape memory.

The above-described interpolation method will hereinafter be explained in more detail, taking a third order interpolation using a third order polynomial as an example.

Figure 4:
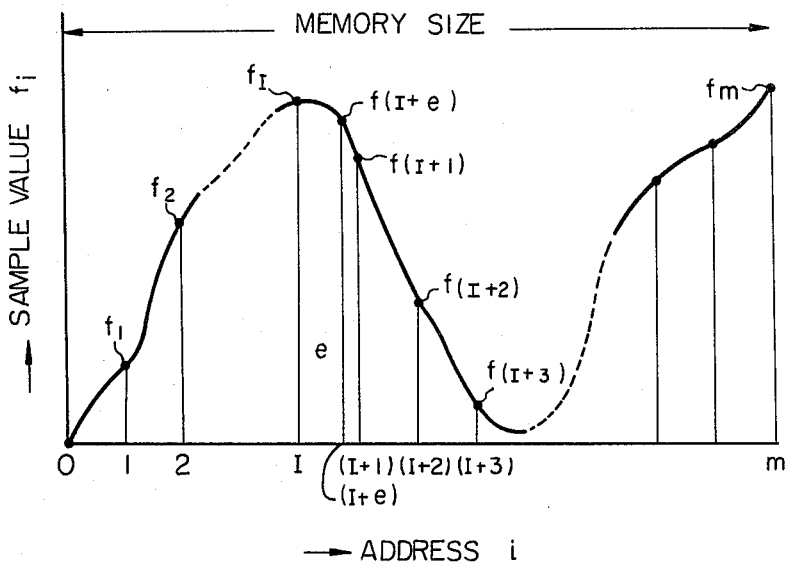
FIG. 4 is a graph for showing another example of the musical tone wave shape to be stored in the wave shape memory.

The following third order interpolation method contemplates theoretical estimation of an unknown sample value f(I+e) (where $0<e<1$) which should be located between the address I and the address (I+1) in FIG. 4 but is not stored in the wave shape memory 4. The interpolation method starts with determining a third order curve F(x) which passes through the four sample values f(I), f(I+1), f(I+2) and f(I+3) stored in the addresses I, (I+1), (I+2) and (I+3), respectively. On the assumption that the sample values between the given sample values f(I) and f(I+1) can be given by this third order curve F(x), the value f(I+e) of the third order curve F(x) at x=I+e is regarded as an approximate sample value f(I+e). The above-described third order curve F(x) is determined in the following manner.

The third order equation F(x) is provisionally formularized as follows:

$$F(x)=A_0X^3+A_1X^2+A_2X+A_3 \quad (1)$$

As the curve represented by the above-described third order equation F(x) passes through the four sample values f(I) through f(I+3), the following four equations are obtained. Here, the address I of the third order equation F(x) is taken (for simplicity) as the origin, at which x=0.

$$\left.\begin{aligned} F(0) &= A_3 = f(I) \\ F(1) &= A_0 + A_1 + A_2 + A_3 = f(I+1) \\ F(2) &= 8A_0 + 4A_1 + 2A_2 + A_3 = f(I+2) \\ F(3) &= 27A_0 + 9A_1 + 3A_2 + A_3 = f(I+3) \end{aligned}\right\} \quad \text{Eq. (2)}$$

The above-described four equations are represented by the following matrix equation:

$$f=Xa \quad (3)$$

where $$f=\begin{pmatrix} fI \\ f(I+1) \\ f(I+2) \\ f(I+3) \end{pmatrix} \quad x=\begin{pmatrix} 0 & 0 & 0 & 1 \\ 1 & 1 & 1 & 1 \\ 8 & 4 & 2 & 1 \\ 27 & 9 & 3 & 1 \end{pmatrix} \quad a=\begin{pmatrix} A_0 \\ A_1 \\ A_2 \\ A_3 \end{pmatrix}$$

The above-described matrix equation (3) is represented by the following equation when an inverted matrix $X^{-1}$ is employed.

$$A=X^{-1}f \quad (4)$$

By substituting $x=(x^3x^2\times 1)$ into equation (1), the following equation (5) is obtained:

$$F(x)=xa \quad (5)$$

By substituting the equation (4) into the equation (5), the following equation (6) is obtained:

$$F(x)=xX^{-1}f \quad (6)$$

The inverted matrix $X^{-1}$ is given by the following equation (7):

$$X^{-1}=\begin{pmatrix} -1/6 & \frac{1}{2} & -\frac{1}{2} & 1/6 \\ 1 & -5/2 & 2 & -\frac{1}{2} \\ -11/6 & 3 & -3/2 & \frac{1}{3} \\ 1 & 0 & 0 & 0 \end{pmatrix} \quad \text{Eq. (7)}$$

By substituting the equation (7) into the equation (6), the latter is rearranged as follows:

$$F(x)=A_0(x)\cdot f(I)+A_1(x)\cdot f(I+1)+A_2(x)\cdot f(I+2)+A_3(x)\cdot f(I+3) \quad (8)$$

where $$\left.\begin{aligned} A_0(x) &= -1/6\,x^3 + x^2 - 11/6\,x + 1 \\ A_1(x) &= \tfrac{1}{2}\,x^3 + -5/2\,x^2 + 3x \\ A_2(x) &= -\tfrac{1}{2}\,x^3 + 2x^2 - 3/2\,x \\ A_3(x) &= 1/6\,x^3 - \tfrac{1}{2}\,x^2 + \tfrac{1}{3}\,x \end{aligned}\right\} \quad \text{Eq. (9)}$$

By making x=e in the equation (8), the sample value f(e), which is not stored in the wave shape memory 4, can be approximately given by the following equation (10);

$$f(e)=F(e)=A_0(e)\cdot f(I)+A_1(e)\cdot f(I+1)+A_2(e)\cdot f(I+2)+A_3(e)\cdot f(I+3) \quad (10)$$

In practice, the unknown sample value f(I+e) as shown in FIG. 4 can be obtained by the following process which is designed on the basis of the above-described equation (10).

As a first step, the four sample values f(I), f(I+1), f(I+2) and f(I+3) shown in FIG. 4 and stored in the successive four addresses are sequentially read out from the wave shape memory 4.

As a second step, an additional memory is provided which stores coefficient values $A_0(e)$ to $A_3(e)$ for various values of "e" and the coefficient values $A_0(e)$ to $A_3(e)$ are read out from the additional memory.

As the third step, calculation is carried out in accordance with the above-described equation (10), using the sample values f(I) to f(I+3) and the coefficient values $A_0(e)$ to $A_3(e)$ in order to estimate the unknown sample value f(I+e) located between the given values f(I) and f(I+1).

When estimation of unknown sample values is to be carried out via an n-th order interpolation method, the process is substantially similar to that of the above-described third order interpolation method, in which process the equation (10) is defined as the basis for the n-th order interpolation.

In the case of n-th order interpolation method, n+1 successive sample values f(I),f(I+1), - - -,f(I+n) are read out from the wave shape memory by time division method. Concurrently with this process, n+1 coefficient values $A_0(e)$, $A_1(e)$ - - - An(e) (where $0<e<1$) are read out from the coefficient memory in accordance with the value of "e" by time division method. In a multiplier, the sample values f(I+p) (where p=0, 1, 2, - - -, n) from the wave shape memory and the coefficient values $A_k(e)$ (where k=0, 1, 2, - - -, n) from the coefficient memory are multiplied by each other by time division method, and the multiplied values $A_k(e)\cdot f(I+p)$ are sequentially accumulated in order to estimate the sample values not stored in the wave shape memory as follows:

$$\sum_{p=k=0}^{n} A_k(e)\cdot f(I+p)$$

Figure 5:
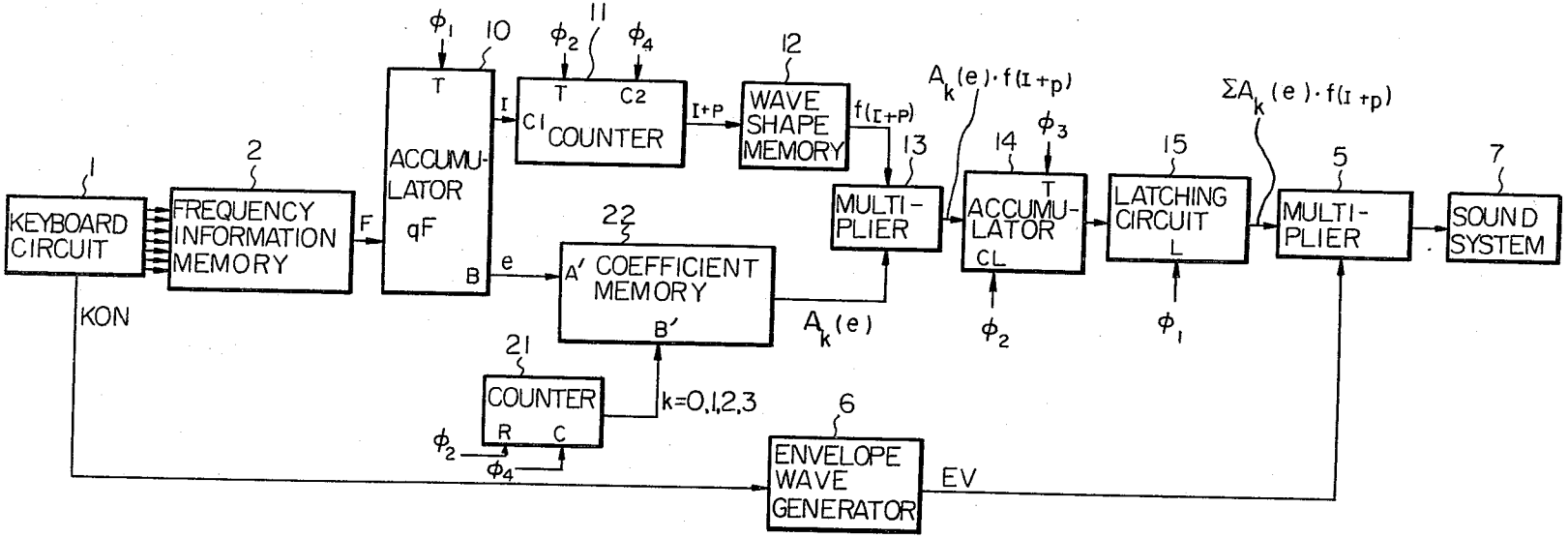
FIG. 5 is a block diagram showing the construction of one embodiment of the wave shape generator in accordance with the present invention.

An embodiment of the wave shape generator in accordance with the present invention is shown in FIG. 5, in which parts and signals substantially similar to those used in the construction shown in FIG. 1 are designated with similar reference numerals and symbols. Operation of this wave shape generator will be described with reference to the case in which estimation of unknown sample values is carried out via the third order interpolation method.

In the construction shown in FIG. 5, the output terminal of the frequency information memory 2 is coupled to the input terminal of an accumulator 10. The accumulation command terminal T of the accumulator 10 receives a series of clock pulse signals $\phi_1$, and causes the count of qF (where q=1, 2, 3, . . .) in accumulator 10 to increase by F each time a new clock pulse signal $\phi^1$ is applied thereto. The accumulator 10 generates a signal I=0, 1, 2 . . . on its output A indicating the number of times its stored count qF has reached its maximum storage capability. This may be referred to as the integer part I. Accumulator 10 further generates a signal on its fractional part output B indicative of the instantaneous count qF in accumulator 10.

The above-described integer part output terminal A of the accumulator 10 is coupled to input terminal C1 counter 11 whose command terminal T receives a series of clock pulse signals $\phi_2$ and whose count input terminal C2 received clock pulse signals $\phi_4$. The output terminal of the counter 11 is coupled, via a wave shape memory 12, to the first input terminal of a multiplier 13.

The above-described fractional part output terminal B of the accumulator 10 is coupled to the first input terminal A' of a coefficient memory 22 whose second input terminal B' is coupled to the output terminal of a counter 21. The clock pulse signals $\phi_2$ are applied to the reset terminal R of the counter 21 while the clock pulse signals $\phi_4$ are applied to the count input terminal C. The output terminal of the coefficient memory 22 is coupled to the second input terminal of the above-described multiplier 13.

The wave shape memory 12 stores a number of sample values fi (where i=1, 2, 3, . . . , m) of a musical tone wave shape such as the one shown in FIG. 4. In the case of this sample value storage by the wave shape memory, there is no need for fine division of the musical tone wave shape, and therefore the wave shape memory 12 can be very compact in construction.

The coefficient memory 22 stores four coefficient values $A_0(e)$, $A_1(e)$, $A_2(e)$ and $A_3(e)$ in accordance with the value of e. The coefficient memory 22 receives as address signals the signal e which is indicative of the instantaneous fractional count in the accumulator 10 and also receives as an address signal a count value k from the counter 21. As noted above, the values $A_0(e)$, $A_1(e)$, $A_2(e)$ and $A_3(e)$ are to be read out of coefficient memory 22. The address e defines the particular intermediate value e which is to be read out of the memory while the count value determines which coefficient value (i.e., $A_0$, $A_1$, $A_2$ or $A_3$) from the above coefficient value from the above-described coefficient values is to be used out of memory. Then, in accordance with the address e generated by accumulator 10 and the address generated by counter 21, coefficient memory 22 outputs a coefficient value $A_k(e)$ to the multiplier 13. For example, when a count value k=0 is applied to the second input terminal B', a coefficient value $A_0(e)$ is nominated in the coefficient memory 22, and when the fractional part e=0.5 is applied to the first input terminal A', a coefficient value $A_0(0.5)$ is outputted from the coefficient memory 22. Here, since no high accuracy is required for operation of the coefficient memory 22, it can be very compact in construction.

The output side of the multiplier 13 is coupled to an accumulator 14. The clear terminal CL of the accumulator 14 receives of the clock pulse signals $\phi_2$ whereas the accumulation command terminal T of the accumulator 14 receives a series of clock pulse signals $\phi_3$. The output terminal of the accumulator 14 is coupled to the input terminal of the multiplier 5 via a latching circuit 15. The latch command terminal L of the latching circuit 15 receives of the clock pulse signals $\phi_1$.

Figure 6:
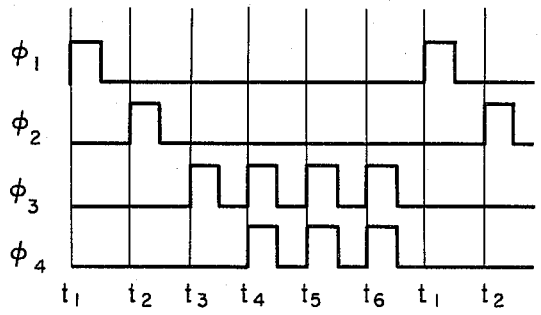
FIG. 6 is a timing chart for clock pulse signals used in the wave shape generator shown in FIG. 5.

The clock pulse signals $\phi_1$ through $\phi_4$ are generated in the sequence shown in FIG. 6.

Operation of the above-described wave shape generator is as follows.

When a certain key is operated, a frequency datum F corresponding to the tonal pitch of the operated key is read out from the frequency information memory 2, which is accumulated by the accumulator 10 at the input timings of the clock pulse signals $\phi_1$.

At a time $t_1$ (see FIG. 6), a clock pulse signal $\phi_1$ is applied to the accumulation command terminal T of the accumulator 10, which thereupon accumulates the frequency datum F and produces an accumulated value qF (q=1). The integer part I of the accumulated value qF(q=1) is outputted from the first output terminal A and the fractional part e thereof is outputted from the second output terminal B.

At time $t_2$, a clock pulse signal $\phi_2$ is applied to input terminal T of the counter 11, which thereupon takes in the integer part I of the accumulated value qF(q=1) from the accumulator 10 and outputs this value as a count value I which is used as a read-out address signal for the wave shape memory 12. Upon receipt of this count value I, the wave shape memory 12 outputs a sample value $f_I$ stored at the address I.

Concurrently with the above-described process, the clock pulse signal $\phi_2$ is also applied to the reset terminal R of the counter 21, thereby resetting the counter 21. The counter 21 reads out a count value k=0. Thus, the coefficient memory 22 receives the fractional part e of the accumulated value qF (q=1) from the accumulator 10 and the count value k=0 as an address signal from the counter 21. This combination of input causes the first coefficient value $A_0(e)$ to be singled out from the four coefficient values $A_0(e)$ through $A_3(e)$ stored in the coefficient memory 22 and passed to the multiplier 13. The multiplier 13 multiplies the sample value $f_I$ from the wave shape memory 12 by the coefficient value $A_0(e)$ from the coefficient memory 22 in order to output a wave shape signal $A_0(e).f_I$. Simultaneously with this, the clock pulse signal $\phi_2$ is applied to the clear terminal CL of the accumulator 14 in order to clear the latter.

At a timing $t_3$, a clock pulse signal $\phi_3$ is inputted to the accumulator command terminal T of the accumulator 14, which thereupon accumulates the above-described wave shape signal $A_0(e).f_I$. Since the accumulator 14 has already been cleared by the clock pulse signal $\phi_2$ at the timing $t_2$, the accumulated value thereof is $A_0(e)\cdot f_I$.

At time $t_4$, a clock pulse signal $\phi_4$ is applied to the count input terminal C2 of the counter 11, which thereupon shifts the count value from I to (I+1). In FIG. 5, the count value by the clock pulse signal $\phi_4$ is designated by "p". This count value (I+1) is applied to the wave shape memory 12 as a new address signal, whereupon the wave shape memory 12 reads out a sample value f(I+1) stored in the address (I+1).

Concurrently with this process, the clock pulse signal $\phi_4$ is applied to the count input terminal C of the counter 21, in which the count value k shifts from 0 to 1. Upon receipt of the fractional part e of the accumulated value qF, (q=1) from the accumulator 10 and the count value k=1 from the counter 21, the coefficient memory 22 outputs the second coefficient value $A_1(e)$ which is singled out from the four coefficient values $A_0(e)$ through $A_3(e)$ corresponding to the value of the fractional part e. The multiplier 13 multiplies the sample value $f_{(I+1)}$ from the wave shape memory 12 by the coefficient value $A_1(e)$ from the coefficient memory 22 to output a wave shape signal $A_1(e)\cdot f_{(I+1)}$.

Further at time $t_4$, a clock pulse signal $\phi_3$ is applied to the accumulation command terminal T of the accumulator 14, whereupon the latter accumulates the above-described wave shape signal $A_1(e)\cdot f_{(I+1)}$, producing an accumulated value $\{A_0(e)\cdot f_{(I)}+A_1(e)\cdot f_{(I+1)}\}$.

Similarly, at time $t_5$, the counter 11 shifts its count value from (I+1) to (I+2) upon receipt of a clock pulse signal $\phi_4$ and outputs the shifted count value (I+2) as a new read-out address signal for the wave shape memory 12. Upon receipt of this address signal (I+2), the wave shape memory 12 outputs the sample value $f_{(I+2)}$ stored at its address (I+2). Concurrently, the counter 21 shifts the count value k from 1 to 2 upon receipt of the clock pulse signal $\phi_4$ and outputs the shifted count value k=2 as new read-out address signal for the coefficient memory 22. Upon receipt of this address signal k=2, the coefficient memory 22 outputs the third coefficient value $A_2(e)$. The multiplier 13 multiplies the sample value $f_{(I+2)}$ from the wave shape memory 12 by the coefficient value $A_2(e)$ from the coefficient memory 22 to output a wave shape signal $A_2(e)\cdot f_{(I+2)}$. Upon receipt of a clock pulse signal $\phi_3$ at the timing $t_5$, the accumulator 14 accumulates the above-described wave shape signal $A_2(e)\cdot f_{(I+2)}$ to produce an accumulated value $\{A_0(e)\cdot f_{(I)}+A_1(e)\cdot f_{(I+1)}+A_2(e)\cdot f_{(I+2)}\}$.

At time $t_6$, the counter 11 shifts its count value from (I+2) to (I+3) upon receipt of a clock pulse signal $\phi_4$ and outputs the shifted count value (I+3) as a new readout address signal for the wave shape memory 12. Upon receipt of this address signal (I+3), the wave shape memory 12 outputs the sample value $f_{(I+3)}$ stored in the address (I+3). Concurrently, the counter 21 shifts its count value k from 2 to 3 upon receipt of the clock pulse signal $\phi_4$ and outputs the shifted count value k=3 as a new readout address signal for the coefficient memory 22. Upon receipt of this address signal k=3, the coefficient memory 22 outputs the fourth coefficient value $A_3(e)$. The multiplier 13 multiplies the sample value $f_{(I+3)}$ from the wave shape memory 12 and the coefficient value $A_3(e)$ from the coefficient memory 22 to output a wave shape signal $A_3(e)\cdot f_{(I+3)}$. Upon receipt of a clock pulse signal $\phi_3$ at time $t_6$, the accumulator 14 accumulates the above-described wave shape signal $A_3(e)\cdot f_{(I+3)}$ to produce an accumulated value $\{A_0(e)\cdot f_{(I)}+A_1(e)\cdot f_{(I+1)}+A_2(e)\cdot f_{(I+2)}+A_3(e)\cdot f_{(I+3)}\}$.

At the next time $t_1$, a clock pulse signal $\phi_1$ is produced and applied to the latch command terminal L of the latching circuit 15, which thereupon latches the above-described wave shape signal $\{A_0(e)\cdot f_{(I)}+A_1(e)\cdot f_{(I+1)}+A_2(e)\cdot f_{(I+2)}+A_3(e)\cdot f_{(I+3)}\}$ from the accumulator 15. The resultant wave shape signal is multiplied by a proper envelope wave shape EV at the multiplier 5 and passed to the sound system 7, which uses it to generate a corresponding musical tone.

Concurrently with the above-described process, the clock pulse signal $\phi_1$ is applied to the accumulation command terminal T of the accumulator 10, which thereupon restarts accumulation of the frequency information F outputted by the frequency information memory 2. The integer part I of the new accumulated value of qF (where q=2) is passed to the counter 11 and the fractional part e of the same is passed to the coefficient memory 22. The above-described sequence of operations at times $t_1$ through $t_6$ ensues.

In the case of the above-described embodiment, the third order interpolation method is used for obtaining the unknown intermediate sample values. However, it should be noted that the above-described embodiment is applicable to estimation of unknown intermediate sample values via the n-th order interpolation also. In such a case, (n+1) sets of coefficient values are stored in the coefficient memory 22 and (n+1) sets of sample values are read out from the wave shape memory 12.

Although the foregoing explanation refers to generation of musical tones only, the present invention can advantageously be applied to generation of envelope wave shapes also.

As the present invention is based on the principle of the mathematical interpolation method, use of a wave shape memory of a compact construction also assures smoothness of the read-out wave shape with respect to and assures generation of wave shapes with greatly reduced quantization noise.

We claim:

1. A waveshape generator for an electronic musical instrument, comprising:

address signal generating means for generating a sequence of first address signals, each of said first address signals including an integer part and a fractional part, said integer part being a non-negative integer I and said fractional part being any one of a discrete number of fractional values $0 \leqq e < 1$;

waveshape memory means for storing a desired waveshape f(x) in the form of m discrete sample values f(i), i=1, 2, . . . , m, each of said sample values f(i) representing the magnitude of said desired waveshape f(x) at a respective discrete location x=i on said waveshape, m being a positive integer; and sum forming means electrically connected to said address signal generator means and to said waveshape memory means, said sum forming means for forming the sum $$\sum_{k=o}^{n} A_k(e) \cdot f(I+k)$$

for each of said first address signals generated by said address signal generating means, $A_k(e)$ being the coefficient values for an nth-order interpolation method of calculating the value f(I+e) from n+1 of said discrete sample values f(i) of said waveshape f(x), wherein f(I+e) is the magnitude of the waveshape f(x) at the point x=I+e, f(I+k) being the magnitude of that said discrete sample value f(i) corresponding to the sampling point i=I+k, n being a positive integer.

2. A waveshape generator according to claim 1, wherein said sum-forming means comprises a coefficient memory means for storing said nth-order interpolation coefficient values $A_k(e)$ for each of said fractional values e.

3. A waveshape generator according to claim 2, wherein said sum-forming means comprises:

means for causing said waveshape memory means to sequentially output said n+1 stored sample values f(I+k) (K=0, 1, . . . ,n); and multiplier means for sequentially multiplying each of said n+1 values f(I+k) by a respective one of said n+1 coefficient values $A_k(e)$ corresponding to said fractional value e.

4. A waveshape generator according to claim 3, wherein said sum-forming means further comprises accumulator means for adding said n+1 products output by said multiplier means to form said sum.

5. A waveshape generator according to claim 2, wherein said sum-forming means comprises first counter means for sequentially applying to said coefficient memory means n+1 signals at predetermined intervals to cause said coefficient memory means to sequentially output said n+1 nth-order interpolation coefficient values $A_k(e)$ corresponding to said fractional value e.

6. A waveshape generator according to claim 5, wherein said means for sequentially causing said waveshape memory means to sequentially output said n+1 stored sample values f(I+k) comprises second counter means for applying n+1 signals at said predetermined intervals to said waveshape memory means to cause said waveshape memory means to sequentially output at said predetermined intervals said n+1 stored sample values f(I+k).

7. A waveshape generator as claimed in claim 1, further comprising a keyboard circuit operable by a player on said electronic musical instrument; and wherein said address signal generating means further comprises frequency information memory means for outputting frequency information signals responsive to the operation of said keyboard circuit, and accumulator means for accumulating said frequency information signals generated by said frequency information memory, whereby said accumulator means stores increasing accumulated values.

8. A waveshape generator as claimed in claim 7, wherein said integer I is equal to the integer part of one of said accumulated values stored in said accumulator means at the instant when said first address signals are generated, and wherein said fraction e is equal to the fractional part of said one of said accumulated values.

9. A waveshape generator as claimed in claim 7, wherein said address signal generating means further comprises counter means for sequentially applying n+1 signals at predetermined intervals to said waveshape memory means to cause said waveshape memory means to sequentially output at said predetermined intervals said n+1 stored sample values f(I+k) to be used to approximate the value of f(I+e).

10. A waveshape generator as claimed in claim 4, further comprising latching circuit means for storing for a predetermined period of time said sum accumulated by said accumulator means.

11. A waveshape generator for electronic musical instruments, comprising:

a waveshape memory storing m+1 first sample values of a waveshape at m+1 respective addresses;

an address signal generator which designates increasing numbers each consisting of an integer i and a fraction e, and generates, for each number i+e, first address signals consisting of n successive integers from i through i+n in a time division multiplexed manner and a second address signal consisting of said fraction e, i being an integer between 0 and m, n being smaller than m, and e being a fraction between 0 and 1;

a circuit connection between said waveshape memory and said address signal generator for causing said waveshape memory to generate successive sample values from the i-th address through the i+n-th address upon receipt of said first address signals;

a coefficient memory which stores coefficients for the n-th order interpolation method and is coupled to said address signal generator for generating n+1 coefficient values for said each number i+e upon receipt of said second address signal in synchronism with said generated n+1 sample values;

a multiplier coupled to said waveshape memory and said coefficient memory and for multiplying said sample values and said coefficient values, respectively; and an accumulator coupled to said multiplier for accumulating n+1 results of said multiplication, the accumulated result consisting of a wave value for said i+e designation.

12. A waveshape generator as claimed in claim 11, in which said musical instrument includes keys and a keyboard circuit and in which said address signal generator comprises:

a frequency information memory coupled to said keyboard circuit for generating a frequency information signal when a certain key is operated; and a second accumulator coupled to said frequency information memory for accumulating generated frequency information signals repeatedly, thereby producing increasing accumulated values.

13. A waveshape generator as claimed in claim 12, in which said integer values i are given in the form of an integer part of said accumulated values and said fractions e are given in the form of a fractional part of said accumulated values.

14. A waveshape generator as claimed in claim 11, in which said address signal generator includes a counter for producing integers i through i+n for each integer value i.

15. A waveshape generator as claimed in claim 11, further comprising a counter coupled to said coefficient memory for reading out n+1 coefficients for each fraction value e.

16. A waveshape generator as claimed in claim 11, further comprising a latching circuit coupled to said accumulator for holding said accumulated result for a period of time predetermined for each number i+e.

* * * * *